US005098326A

United States Patent [19]

Gorczyca et al.

[11] Patent Number: 5,098,326

[45] Date of Patent: Mar. 24, 1992

[54] METHOD FOR APPLYING A PROTECTIVE COATING TO A HIGH-INTENSITY METAL HALIDE DISCHARGE LAMP

[75] Inventors: Thomas Gorczyca, Schenectady; Harald L. Witting, Burnt Hills, both of N.Y.

[73] Assignee: General Electric Company, Schenectady, N.Y.

[21] Appl. No.: 627,110

[22] Filed: Dec. 13, 1990

[51] Int. Cl.[5] ..... H01J 9/20

[52] U.S. Cl. ..... 445/26; 445/58; 427/107

[58] Field of Search ..... 445/10, 17, 26, 18, 445/58; 427/107, 124, 252

[56] References Cited

U.S. PATENT DOCUMENTS

| | | | |
|---|---|---|---|
| 2,183,302 | 12/1939 | Brauer | 445/10 |
| 3,729,335 | 4/1973 | Domrachev et al. | 427/252 |
| 4,374,157 | 2/1983 | Barbier et al. | 427/107 |
| 4,810,938 | 3/1989 | Johnson et al. | 315/248 |
| 4,812,702 | 3/1989 | Anderson | 313/153 |
| 4,857,097 | 8/1989 | Berry | 427/252 |
| 4,972,120 | 11/1990 | Witting | 313/638 |

FOREIGN PATENT DOCUMENTS

| | | | |
|---|---|---|---|
| 269558 | 11/1927 | United Kingdom | 427/124 |
| 1248747 | 10/1971 | United Kingdom | 427/252 |

OTHER PUBLICATIONS

Waymouth, John F., *Electric Discharge Lamps*, M.I.T. Press 1971, pp. 266–277.

*Primary Examiner*—Kurt Rowan
*Assistant Examiner*—Jeffrey T. Knapp
*Attorney, Agent, or Firm*—Jill M. Breedlove; James C. Davis, Jr.; Marvin Snyder

[57] ABSTRACT

A method for applying a protective coating to the inner surface of the arc tube of a high-intensity metal halide discharge lamp involves dosing the arc tube with an inert gas that is doped with a metal hydride gas. Preferably, the metal hydride gas comprises silane. The arc tube is heated to a sufficiently high temperature to decompose the silane gas. As a result, silicon is deposited as a protective coating on the inner surface of the arc tube wall. The hydrogen gas that is generated by the silane decomposition is removed from the system either by pumping it out before dosing the arc tube with the final arc tube fill, or by diffusion through the arc tube wall during operation of the lamp.

16 Claims, 1 Drawing Sheet

METHOD FOR APPLYING A PROTECTIVE COATING TO A HIGH-INTENSITY METAL HALIDE DISCHARGE LAMP

FIELD OF THE INVENTION

The present invention relates generally to high-intensity metal halide discharge lamps. More particularly, the present invention relates to a method for applying a protective coating to the inner surface of the arc tube of such a lamp.

BACKGROUND OF THE INVENTION

In operation of a high-intensity metal halide discharge lamp, visible radiation is emitted by the metallic portion of the metal halide fill at relatively high pressure upon excitation typically caused by passage of current therethrough. One class of high-intensity metal halide lamps comprises electrodeless lamps which generate an arc discharge by establishing a solenoidal electric field in the high-pressure gaseous lamp fill comprising the combination of one or more metal halides and an inert buffer gas. In particular, the lamp fill, or discharge plasma, is excited by radio frequency (RF) current in an excitation coil surrounding an arc tube which contains the fill. The arc tube and excitation coil assembly acts essentially is a transformer which couples RF energy to the plasma. That is, the excitation coil acts as a primary coil, and the plasma functions as a single-turn secondary. RF current is the excitation coil produces a time-varying magnetic field, in turn creating an electric field in the plasma which closes completely upon itself, i.e., a solenoidal electric field. Current flows as a result of this electric field, thus producing a toroidal arc discharge in the arc tube.

High-intensity, metal halide discharge lamps, such as the aforementioned electrodeless lamps, generally provide good color rendition and high efficacy in accordance with the principles of general purpose illumination. However, the lifetime of such lamps can be limited by the loss of the metallic portion of the metal halide fill during lamp operation and the corresponding buildup of free halogen. In particular, the loss of the metal atoms shortens the useful life of the lamp by reducing the visible light output. Moreover, the loss of the metal atoms leads to the release of free halogen into the arc tube, which may cause arc instability and eventual arc extinction, especially in electrodeless high-intensity metal halide discharge lamps.

The loss of the metallic portion of the metal halide fill may be attributable to the electric field of the arc discharge which moves metal ions to the arc tube wall. For example, as explained in *Electric Discharge Lamps* by John F. Waymouth, M.I.T. Press, 1971, pp. 266–277, in a high-intensity discharge lamp containing a sodium iodide fill, sodium iodide is dissociated by the arc discharge into positive sodium ions and negative iodine ions. The positive sodium ions are driven towards the arc tube wall by the electric field of the arc discharge. Sodium ions which do not recombine with iodine ions before reaching the wall may react chemically at the wall, or they may pass through the wall and then react outside the arc tube. (Normally, there is an outer light-transmissive envelope disposed about the arc tube.) These sodium ions may react to form sodium silicate or sodium oxide by reacting with a silica arc tube or with oxygen impurities. As more and more sodium atoms are lost, light output decreases, and there is also a buildup of free iodine within the arc tube that may lead to arc instability and eventual arc extinction. Furthermore, the arc tube surface may degrade as a result of the ion bombardment.

As described in commonly assigned, copending U.S. patent application of Witting et al., entitled "Protective Coating for High-Intensity Metal Halide Discharge Lamps", Ser. No. 553,304, filed July 16, 1990, now allowed a suitable protective coating comprises, for example, a silicon layer which is sufficiently thick to prevent a substantial loss of the metallic component of the metal halide fill, but which is also sufficiently thin so as to allow only minimal blockage of visible light output from the arc tube. According to the cited patent application, which is incorporated by reference herein, one method of applying the protective coating involves a chemical vapor deposition process wherein the coating is initially applied to both the inner and outer surfaces of the arc tube, the outer coating being subsequently removed by immersing the arc tube in a suitable etchant.

Although the method of the hereinabove cited Witting et al. patent application, Ser. No. 553,304, is effective in applying a protective coating to arc tubes of high-intensity metal halide discharge lamps, it may be desirable to provide a simpler method of applying such a coating, thereby simplifying the lamp manufacturing process.

Accordingly, an object of the present invention is to provide a new and improved method for applying a protective coating to the inner surface of an arc tube of a high-intensity metal halide discharge lamp.

SUMMARY OF THE INVENTION

The foregoing and other objects of the present invention are achieved in a method for applying a protective coating to the inner surface of the arc tube of a high-intensity metal halide discharge lamp which involves dosing the arc tube with an inert gas that is doped with a metal hydride gas. Preferably, the metal hydride gas comprises silicon hydride, or silane. The silane gas is decomposed into silicon and hydrogen by exposing the arc tube to a temperature of approximately 550° C., either by heating in an oven or by driving a discharge in the arc tube. As a result, silicon is deposited as a protective coating on the inner surface of the arc tube wall. The hydrogen gas generated by the silane decomposition is removed from the arc tube either by pumping it out before dosing the arc tube with its final fill, or by gradual diffusion through the arc tube wall during lamp operation.

BRIEF DESCRIPTION OF THE DRAWINGS

The features and advantages of the present invention will become apparent from the following detailed description of the invention when read with the sole accompanying drawing FIGURE which illustrates a high-intensity metal halide discharge lamp having a protective coating of a type described herein.

DETAILED DESCRIPTION OF THE INVENTION

Figure 1:
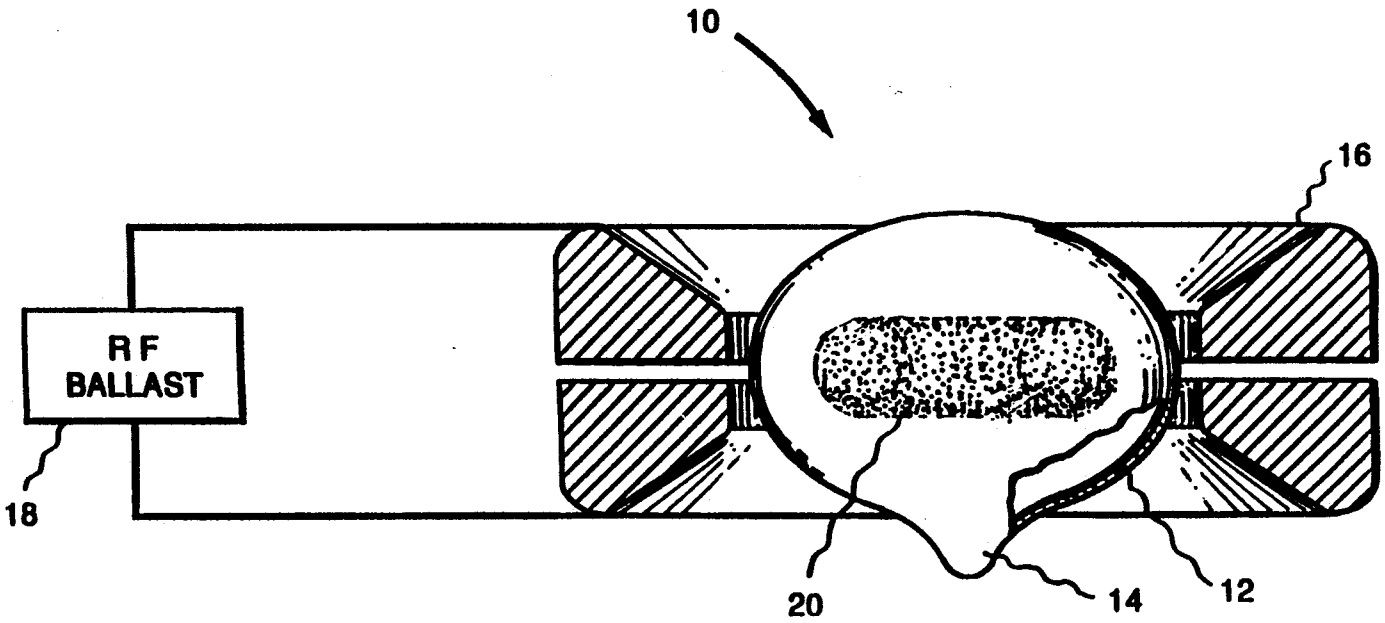

The sole drawing FIGURE illustrates a high-intensity, metal halide discharge lamp 10 employing a protective coating 12 in accordance with the present invention. For purposes of illustration, lamp 10 is shown as an electrodeless high-intensity metal halide discharge lamp. However, it is to be understood that the principles of the present invention apply equally well to high-intensity metal halide discharge lamps having electrodes. As shown, electrodeless metal halide discharge lamp 10 includes an arc tube 14 formed of a high temperature glass, such as fused silica, or an optically transparent ceramic, such as polycrystalline alumina. By way of example, arc tube 14 is shown as having a substantially ellipsoid shape. However, arc tubes of other shapes may be desirable, depending upon the application. For example, arc tube 14 may be spherical or may have the shape of a short cylinder, or "pillbox", having rounded edges, if desired.

Arc tube 14 contains a metal halide fill in which a solenoidal arc discharge is excited during lamp operation. A suitable fill, described in commonly assigned U.S. Pat. No. 4,810,938 of P. D. Johnson, J. T. Dakin and J. M. Anderson, issued on Mar. 7, 1989, comprises a sodium halide, a cerium halide and xenon combined in weight proportions to generate visible radiation exhibiting high efficacy and good color rendering capability at white color temperatures. For example, such a fill according to the Johnson et al. patent may comprise sodium iodide and cerium chloride, in equal weight proportions, in combination with xenon at a partial pressure of about 500 torr. The Johnson et al. patent is incorporated by reference herein. Another suitable fill is described in commonly assigned U.S. Pat. No. 4,972,120, issued Nov. 20, 1990 to H. L. Witting, which patent is incorporated by reference herein. The fill of Witting U.S. Pat No. 4,972,120 comprises a combination of a lanthanum halide, a sodium halide, a cerium halide and xenon or krypton as a buffer gas. For example, a fill according to the Witting patent may comprise a combination of lanthanum iodide, sodium iodide, cerium iodide, and 250 torr partial pressure of xenon.

Electrical power is applied to the HID lamp by an excitation coil 16 disposed about arc tube 14 which is driven by an RF signal via a ballast 18. A suitable excitation coil 16 may comprise, for example, a two-turn coil having a configuration such as that described in commonly assigned, copending U.S patent application of G. A. Farrall, Ser. No. 493,266, filed Mar. 14, 1990, now allowed which patent application is incorporated by reference herein. Such a coil configuration results in very high efficiency and causes only minimal blockage of light from the lamp. The overall shape of the excitation coil of the Farrall application is generally that of a surface formed by rotating a bilaterally symmetrical trapezoid about a coil center line situated in the same plane as the trapezoid, but which line does not intersect the trapezoid. However, other suitable coil configurations may be used, such as that described in commonly assigned U.S. Pat. No. 4,812,702 of J. M. Anderson, issued Mar. 14, 1989, which patent is incorporated by reference herein. In particular, the Anderson patent describes a coil having six turns which are arranged to have a substantially V-shaped cross section on each side of a coil center line. Still another suitable excitation coil may be of solenoidal shape, for example.

In operation, RF current in coil 16 results in a time-varying magnetic field which produces within arc tube 14 an electric field that completely closes upon itself. Current flows through the fill within arc tube 14 as a result of this solenoidal electric field, producing a toroidal arc discharge 20 in arc tube 14. The operation of an exemplary electrodeless HID lamp is described in Johnson et al. U.S. Pat. No. 4,810,938, cited hereinabove.

The protective coating 12 on the inner surface of arc tube 14 is of sufficient thickness to prevent a substantial loss of the metallic portion of the metal halide fill and hence a corresponding substantial buildup of free halogen. In addition, the protective coating is sufficiently thin to allow only minimal blockage of visible light output from the arc tube. Advantageously, since the metallic portion of the fill generates the visible radiation during lamp operation, the useful life of the lamp is extended by preventing a substantial loss thereof. Furthermore, since a buildup of free halogen typically causes arc instability and eventual arc extinction, preventing such a buildup likewise extends the useful life of the lamp.

In a preferred embodiment of lamp 10, as described in Witting et al. U.S. patent application, Ser. No. 553,304, cited hereinabove, arc tube 14 is comprised of fused silica, and protective coating 12 comprises a layer of silicon. A preferred thickness of silicon coating 12 is between 3 and 40 nanometers, with a more preferred range being from 10 to 20 nanometers. Silicon is a preferred protective coating because it has a relatively low thermal expansion coefficient and a high melting point. In addition, silicon may be advantageously employed as a coating on fused silica arc tubes because it is chemically compatible with silica and because it reacts with oxygen impurities to form silica. Moreover, for metal halide lamps having sodium as one of the fill ingredients, silicon is a preferred coating because it is a poor solvent for sodium and does not form compounds therewith.

In accordance with a preferred embodiment of the present invention, silicon coating 12 is applied to the inner surface of arc tube 14 by filling the arc tube with an inert gas that is doped with silicon hydride, or silane, and then heating the arc tube for a suitable time period, e.g. 1 to 90 minutes, in the range from approximately 500° C. to 900° C. Heating of the arc tube can be accomplished either by heating in an oven or by driving a discharge in the arc tube, or a combination thereof. In particular, heating of the arc tube in an oven causes the silane gas to decompose thermally. On the other hand, driving a discharge in the arc tube results in both thermal and plasma decomposition of the silane gas. In either case, however, silane decomposition causes nucleation and deposition of silicon coating 12 on the inner surface of arc tube 14. The total silicon content inside the arc tube and the resulting average silicon coating thickness are determined by the partial pressure of the silane gas. Those skilled in the art of chemical vapor deposition will recognize that the coating time can be reduced by increasing the coating temperature and that the coating temperature can be reduced if the coating time is increased. Moreover, if heating is accomplished by driving a discharge, the plasma decomposition further reduces the coating time. After coating 12 has been applied to the inner surface of arc tube 14, the arc tube is evacuated in order to remove the hydrogen that was generated by the dissociation of the silane. The arc tube is then filled with a typical dose of at least one metal halide and at least one inert gas, and finally sealed.

EXAMPLE

A fused silica arc tube of spherical shape having an inside volume of 3 cubic centimeters is filled with a 5% silane-doped inert gas to a total pressure of 250 torr and is heated for 5 minutes in an oven at approximately 550° C. As a result, approximately 0.05 milligram of silicon is deposited as a coating having a thickness of approximately 20 nanometers on the inner surface of the arc tube. The arc tube is then evacuated in order to remove the hydrogen that was generated by the dissociation of the silane. The arc tube is then filled with a solid dose of 4.75 milligrams of sodium iodide and 2.25 milligrams of cerium iodide, and also with a gaseous dose of krypton, and finally sealed.

An alternative method of the present invention involves adding the silane gas directly to the arc tube fill which typically includes at least one metal halide and at least one inert gas. The arc tube is sealed and then heated either in an oven or by driving a discharge in the arc tube, or by a combination thereof. As a result, silicon coating 12 is deposited on the inner surface of the arc tube wall. The hydrogen gas that is generated by the decomposition of silane is removed by diffusion through the hot arc tube wall. Hydrogen diffuses through hot silica at a relatively fast rate due to its small atomic diameter.

EXAMPLE

A fused silica arc tube of spherical shape having an inside volume of 3 cubic centimeters is filled with a solid dose of 4.75 milligrams of sodium iodide and 2.25 milligrams of cerium iodide, and with a gas dose of 95% krypton and 5% silane at a total pressure of 250 torr. The arc tube is sealed and then heated for 30 minutes at approximately 550° C. As a result, silicon in the quantity of approximately 0.05 milligram is deposited on the inner surface of the arc tube as a coating having a thickness of approximately 20 nanometers. A discharge is then driven in the arc tube for an additional 60 minutes. The discharge heats the arc tube to a temperature of approximately 800° C. and allows free hydrogen to diffuse through the arc tube wall.

Although the method of the present invention has been described in detail with reference to a silicon coating, it is to be understood that the method of the present invention may be used to apply to high-intensity metal halide discharge lamps other suitable protective coatings comprising, for example, other metals or metal silicates.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method for applying a protective metal coating to the inner surface of the arc tube of a high-intensity discharge lamp, comprising the steps of:

filling said arc with an inert gas that is doped with a metal hydride of a predetermined quantity;

heating said arc tube at a sufficiently high temperature for a sufficiently long period of time to decompose said metal hydride in order to form a metal coating on the inner surface of said arc tube;

evacuating said arc tube; and filling said arc tube with a solid dose including at least one metal halide and with a gaseous dose including at least one inert gas; and sealing said arc tube.

2. The method of claim 1 wherein the step of heating said arc tube comprises heating in an oven.

3. The method of claim 1 wherein the step of heating said arc tube comprises operating the lamp.

4. The method of claim 1 wherein said metal hydride comprises silane and said coating comprises silicon.

5. The method of claim 4 wherein said temperature is in the range from approximately 500° C. to 900° C.

6. The method of claim 5 wherein said temperature is approximately 550° C.

7. The method of claim 1 wherein said protective coating has a thickness in the range from approximately 3 to 40 nanometers.

8. The method of claim 7 wherein said protective coating has a thickness in the range from approximately 10 to 20 nanometers.

9. A method for applying a protective metal coating to the inner surface of the arc tube of a high-intensity discharge lamp, comprising the steps of:

filling said arc tube with a gaseous dose, including at least one inert gas and a metal hydride, and with a solid dose, including at least one metal halide, to a predetermined pressure;

sealing said arc tube; and heating said arc tube at a sufficiently high temperature for a sufficiently long period of time to decompose said metal hydride in order to form a metal coating on the inner surface of said arc tube and to allow hydrogen generated from the decomposition of said metal hydride to diffuse from said arc tube.

10. The method of claim 9 wherein the step of heating said arc tube comprises heating in an oven.

11. The method of claim 9 wherein the step of heating said arc tube comprises operating the lamp.

12. The method of claim 9 wherein said metal hydride comprises silane and said coating comprises silicon.

13. The method of claim 12 wherein said temperature is in the range from approximately 500° C. to 900° C.

14. The method of claim 13 wherein said temperature is approximately 550° C.

15. The method of claim 9 wherein said protective coating has a thickness in the range from approximately 3 to 40 nanometers.

16. The method of claim 15 wherein said protective coating has a thickness in the range from approximately 10 to 20 nanometers.

* * * * *